US007358667B2

(12) United States Patent
Kang et al.

(10) Patent No.: US 7,358,667 B2
(45) Date of Patent: Apr. 15, 2008

(54) PLASMA DISPLAY PANEL

(75) Inventors: Tae-Kyoung Kang, Suwon-si (KR); Yong-Jun Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 586 days.

(21) Appl. No.: 10/933,430

(22) Filed: Sep. 3, 2004

(65) Prior Publication Data

US 2005/0062418 A1 Mar. 24, 2005

(30) Foreign Application Priority Data

Sep. 4, 2003 (KR) ..... 10-2003-0061862

(51) Int. Cl.
*H01J 17/49* (2006.01)

(52) U.S. Cl. ..... 313/582; 313/583; 313/584

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,369,501 | B1 * | 4/2002 | Aoki et al. | 313/486 |
| 6,373,195 | B1 * | 4/2002 | Whang et al. | 315/169.3 |
| 6,479,932 | B1 * | 11/2002 | Nunomura | 313/582 |
| 6,489,722 | B1 * | 12/2002 | Yoshida et al. | 313/582 |
| 6,630,916 | B1 | 10/2003 | Shinoda | |
| 6,703,772 | B2 * | 3/2004 | Hasegawa et al. | 313/384 |

(Continued)

FOREIGN PATENT DOCUMENTS

CN 1407583 4/2003

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Mariceli Santiago
*Assistant Examiner*—José M Díaz
(74) *Attorney, Agent, or Firm*—Robert E. Bushnell, Esq.

(57) ABSTRACT

A plasma display panel includes designed to improve optical efficiently and to reduce misdischarging between discharge cells. The address electrodes have varying widths so that they are narrow in discharge cells and are relatively wide outside of discharge cells. Discharge gas filling the discharge cells have an elevated Xe content, preferably 10 to 30%. Other variations further include having striped and matrix patterned barrier ribs, forming the discharge sustain electrodes in tabs extending in pairs into the middle of the discharge cells, and varying the width of address electrodes at various locations outside of the discharge cells.

18 Claims, 8 Drawing Sheets

U.S. PATENT DOCUMENTS

| | | | | |
|---|---|---|---|---|
| 6,707,436 | B2 | 3/2004 | Setoguchi et al. | |
| 6,714,175 | B1 * | 3/2004 | Shimada et al. | 345/60 |
| 7,034,443 | B2 * | 4/2006 | Ahn et al. | 313/292 |
| 7,067,977 | B2 * | 6/2006 | Kim | 313/582 |
| 7,170,226 | B2 * | 1/2007 | Su et al. | 313/582 |
| 7,208,876 | B2 * | 4/2007 | Kang et al. | 313/582 |
| 2002/0063524 | A1 * | 5/2002 | Nakamura et al. | 313/582 |
| 2003/0034734 | A1 * | 2/2003 | Kim et al. | 313/582 |
| 2003/0168979 | A1 * | 9/2003 | Ahn et al. | 313/587 |
| 2004/0256989 | A1 * | 12/2004 | Kim et al. | 313/584 |
| 2005/0001551 | A1 * | 1/2005 | Kim et al. | 313/584 |
| 2005/0029939 | A1 * | 2/2005 | Woo et al. | 313/582 |
| 2005/0046350 | A1 * | 3/2005 | Su et al. | 313/582 |

FOREIGN PATENT DOCUMENTS

| | | | |
|---|---|---|---|
| JP | 02-148645 | | 6/1990 |
| JP | 2845183 | | 10/1998 |
| JP | 2917279 | | 4/1999 |
| JP | 2001-043804 | | 2/2001 |
| JP | 2001126629 | A * | 5/2001 |
| JP | 2001-325888 | | 11/2001 |

* cited by examiner

PLASMA DISPLAY PANEL

CLAIM OF PRIORITY

This application makes reference to and claims all benefits accruing under 35 U.S.C. §119 from an application for PLASMA DISPLAY PANEL earlier filed in the Korean Intellectual Property Office on the 4th day of September 2003 and there duly assigned Serial No. 2003-61862.

BACKGROUND OF THE INVENTION

1. Field of the Invention

The present invention relates to a plasma display panel, and in particular, to a plasma display panel with an improved structure for address electrode that prevents mis-discharging in discharge cells, especially in plasma display panels with high definition.

2. Description of Related Art

Generally, a plasma display panel (referred to hereinafter simply as a "PDP") is a display device which displays images by exciting phosphors with vacuum ultraviolet rays generated due to discharging of gas within a discharge cell. PDPs are classified into an alternating current type and a direct current type, depending upon the voltage application, and into a face discharge type and a surface discharge type, depending upon the forms of electrode construction. Recently, an alternating current type of PDP with a triode surface discharge structure has been used extensively.

However, as PDP's become more high definition and thus the structures within the display become smaller, a growing problem of mis-discharging or an accidental discharge is becoming more severe. What is needed is a design for a PDP that reduces or eliminates the problem of mis-discharging in high definition PDP's.

SUMMARY OF THE INVENTION

It is therefore an object of the present invention to provide an improved design for a PDP.

It is also an object of the present invention to provide an improved design for a PDP that reduces mis discharging between discharge cells when the PDP is a high definition display with elevated levels of Xe gas in the discharge cells.

It is also an object of the present invention to provide improved electrode design in a PDP to prevent inter discharge cell discharging for high definition PDPs.

It is further an object of the present invention to provide a PDP which inhibits interaction between the address electrode and the display electrode, increases the content of Xe in the discharge gas, and allows precise driving thereof without incurring abnormal inter-cell discharging.

These and other objects may be achieved by a PDP with the following features. According to one aspect of the present invention, the PDP includes first and second substrates facing each other with a distance therebetween. Address electrodes are formed on the first substrate, and barrier ribs are disposed between the first and the second substrates to partition the discharge cells. A phosphor layer is formed within the respective discharge cells. Discharge sustain electrodes are formed on the second substrate. When the distance between the portions of the discharge sustain electrode at the respective discharge cells is called a main discharge gap, and the distance between the discharge sustain electrodes at the two neighboring discharge cells is called a non-discharge gap, the width of the address electrode in the vicinity of the main discharge gap is smaller than the width of the address electrode in the vicinity of the non-discharge gap. The width of the address electrode corresponding to the main discharge gap is 40~140 μm. The discharge cell is internally filled with a discharge gas containing 10~30% of Xe.

The address electrode corresponding to the non-discharge gap is partially differentiated in the longitudinal direction thereof. The width of the address electrode corresponding to the center of the non-discharge gap can be made to be smaller than the width of the address electrode corresponding to both end portions of the non-discharge gap. The width of the address electrode corresponding to the center of the non-discharge gap can be made to have substantially the same width as the width of the address electrode corresponding to the main discharge gap.

According to another aspect of the present invention, the PDP includes first and second substrates facing each other with a distance therebetween. Address electrodes are formed on the first substrate. Barrier ribs are disposed between the first and the second substrates to partition the discharge cells, and a phosphor layer is formed within the respective discharge cells. Discharge sustain electrodes are formed on the second substrate. Each discharge sustain electrode has a scanning electrode and a display electrode. When a horizontal axis line drawn on the center of the scanning electrode and is called a first horizontal axis line, a horizontal axis line drawn on the center of the display electrode is called a second horizontal axis line, a section between the first and the second horizontal axis lines within any single discharge cell is called a main discharge section, and a section between the first and the second horizontal axis lines of neighboring discharge cells is called a non-discharge section, the width of the address electrode in the main discharge section is smaller than the width of the address electrode in the non-discharge section.

The address electrode corresponding to the non-discharge section can be partially differentiated in the longitudinal direction thereof. The width of the address electrode corresponding to the center of the non-discharge section can be made to be smaller than the width of the address electrode corresponding to both end portions of the non-discharge section. The width of the address electrode corresponding to the center of the non-discharge section is substantially the same as the width of the address electrode corresponding to the main discharge section. The barrier ribs are stripe-patterned, and parallel to the address electrodes. The barrier ribs can also be lattice-shaped with a first barrier rib portion proceeding in the direction of the address electrode, and a second barrier rib portion proceeding in the direction of the discharge sustain electrode. The scanning electrode and the display electrode each have a transparent portion, and a bus portion formed on one side periphery of the transparent portion and being electrically connected to the transparent portion. The transparent portions can be protruded toward the center of the respective discharge cells, and face each other in pairs.

BRIEF DESCRIPTION OF THE DRAWINGS

A more complete appreciation of the invention, and many of the advantages thereof, will be readily apparent as the same becomes better understood by reference to the following detailed description when considered in conjunction with the accompanying drawings in which like reference symbols indicates the same or similar components, wherein.

DETAILED DESCRIPTION OF THE INVENTION

Figure 1:
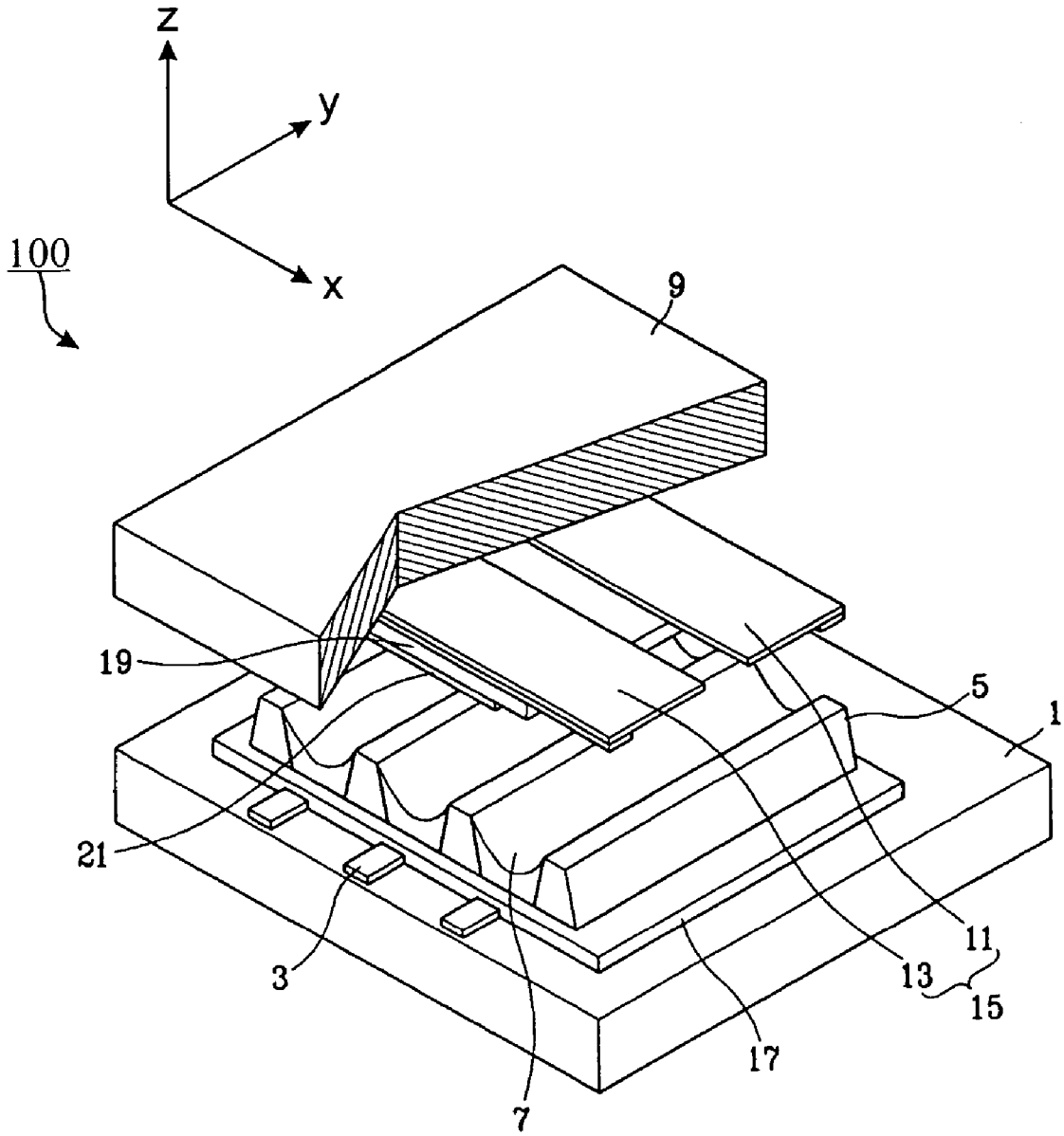
FIG. 1 is a partial exploded perspective view of a PDP.

Turning now to the figures, FIG. 1 illustrates an alternating current type PDP 100. PDP 100 of FIG. 1 includes an address electrode 3, a barrier rib 5, and a phosphor layer 7 formed on a rear substrate 1 at respective discharge cells. On the front substrate 9 is formed a discharge sustain electrode 15 which is a scanning electrode 11 paired with a display electrode 13. Dielectric layers 17 and 19 cover the address electrode 3 and the discharge sustain electrode 15, respectively. The discharge cell is internally filled with a discharge gas (mainly a mixture gas of Ne—Xe). In PDP 100 of FIG. 1, an MgO protective layer 21 is formed to cover dielectric layer 19.

In the PDP 100 of FIG. 1, when an address voltage Va is applied between the address electrode 3 and the scanning electrode 11, address discharging occurs within the discharge cell so that wall charges build up on the dielectric layer 19 near the scanning and the display electrodes 11 and 13 as well as on the dielectric layer 17 near the address electrode 3, thus selecting the discharge cells to emit light. Thereafter, a sustain voltage Vs is applied between the scanning electrode 11 and the display electrode 13 causing wall charges accumulated near the scanning electrode 11 to collide with charges accumulated near the display electrode 13 to thereby generate a plasma discharge or a sustain discharge. At this time, vacuum ultraviolet rays are emitted from the excited atoms of Xe during the plasma discharging. The vacuum ultraviolet rays excite the phosphor layers 7 to emit visible rays, and display color images.

With the PDP 100, in the case that the barrier ribs 5 are stripe-patterned, the interiors of the discharge cells are connected to each other in the direction of the address electrodes 3 (i.e., the y-direction). Consequently, the space (or wall) charges are able to migrate to the interiors of the neighboring discharge cells in this y-direction, causing inter-cell discharging. Furthermore, in case the barrier ribs 5 are formed with other patterns, the discharging of some discharge cells can affect the neighboring discharge cells in the y-direction of the address electrodes, thereby causing abnormal inter-cell discharging.

In recent years, PDPs are more and more being designed to have a high definition structure, and the inter-cell pitch has thus shortened, further exacerbating the inter-cell abnormal discharging problem. Particularly when the address electrodes 3 are in a stripe-patterned as in FIG. 1 with a uniform longitudinal width, portions of the address electrodes 3 that face the scanning electrodes 11 can induce the address discharging with a predetermined distance thereto, and to the display electrode 13 not committed to the address discharging with a predetermined distance thereto. With such a structure, when the PDP is operated, even after the reset interval of deleting the information memorized at the discharge cells, wall discharges are liable to be generated in the discharge cells due to the interaction between the address electrode 3 and the display electrode 13, thereby causing abnormal discharging.

Meanwhile, in the field of plasma displays, in order to enhance the discharge efficiency, a content of Xe in the discharge gas is increased to increase the intensity of the vacuum ultraviolet rays. However, when only the content of Xe is increased without improving the internal structure of the PDP, the driving voltage of the PDP needs to be elevated, causing the power consumption thereof to increase. Furthermore, as the content of Xe is increased, the abnormal discharging between the address electrode 3 and the display electrode 13 occurs more frequently, and it more becomes difficult to precisely operate the PDP.

Figure 2:
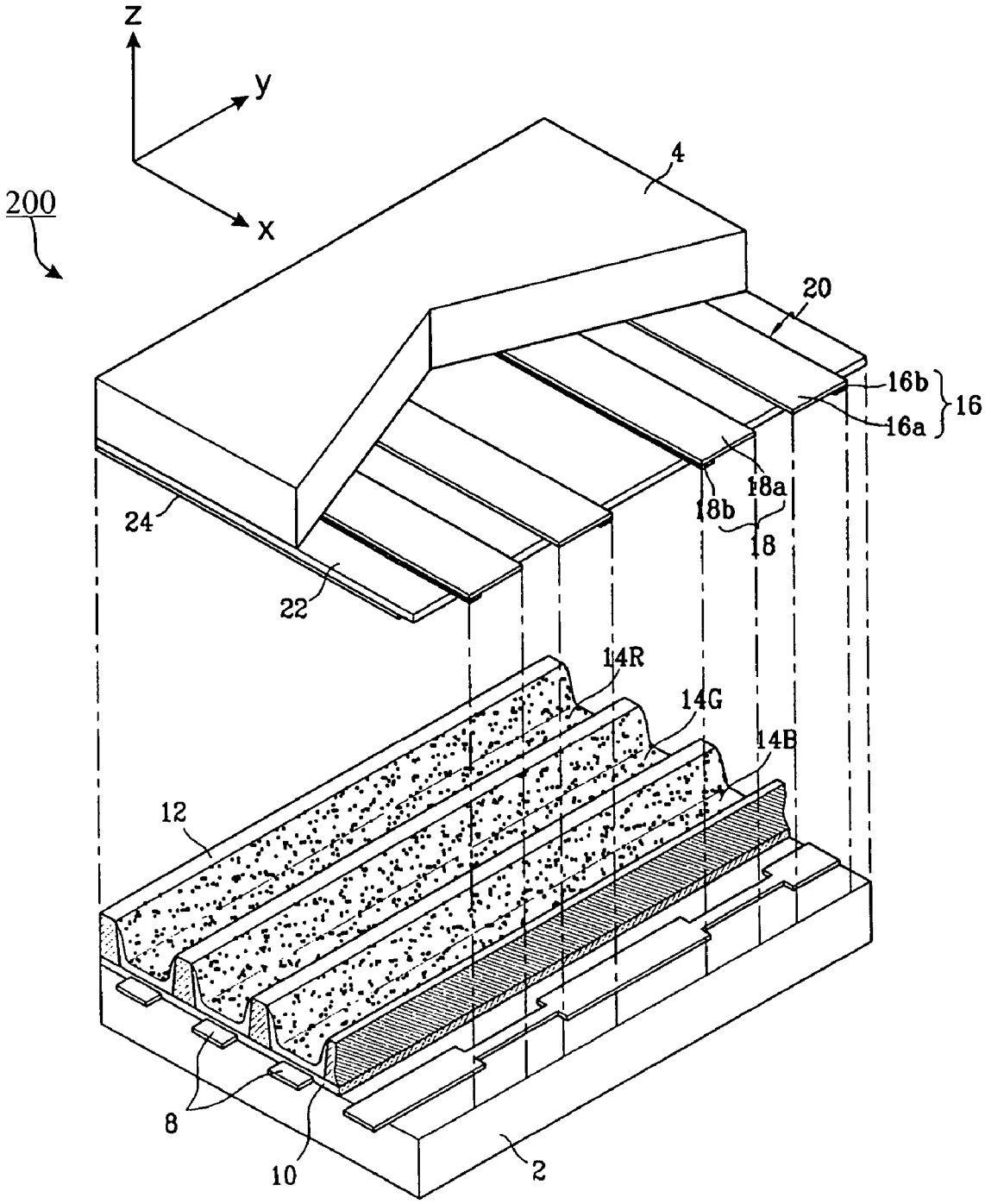
FIG. 2 is a partial exploded perspective view of a PDP according to an embodiment of the present invention.
Figure 3:
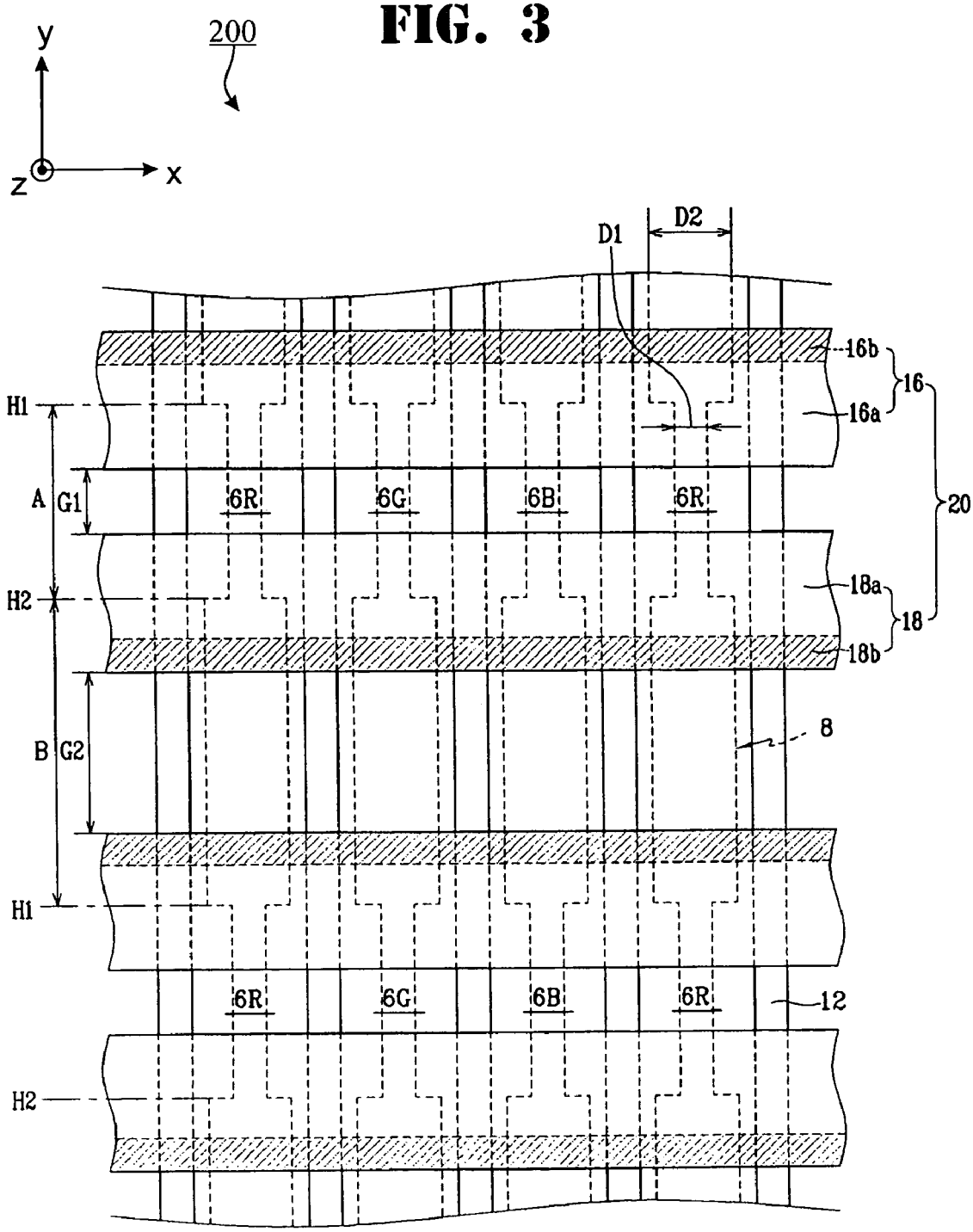
FIG. 3 is a partial plan view of the PDP illustrated in FIG. 2, illustrating the combined structure thereof.
Figure 4:
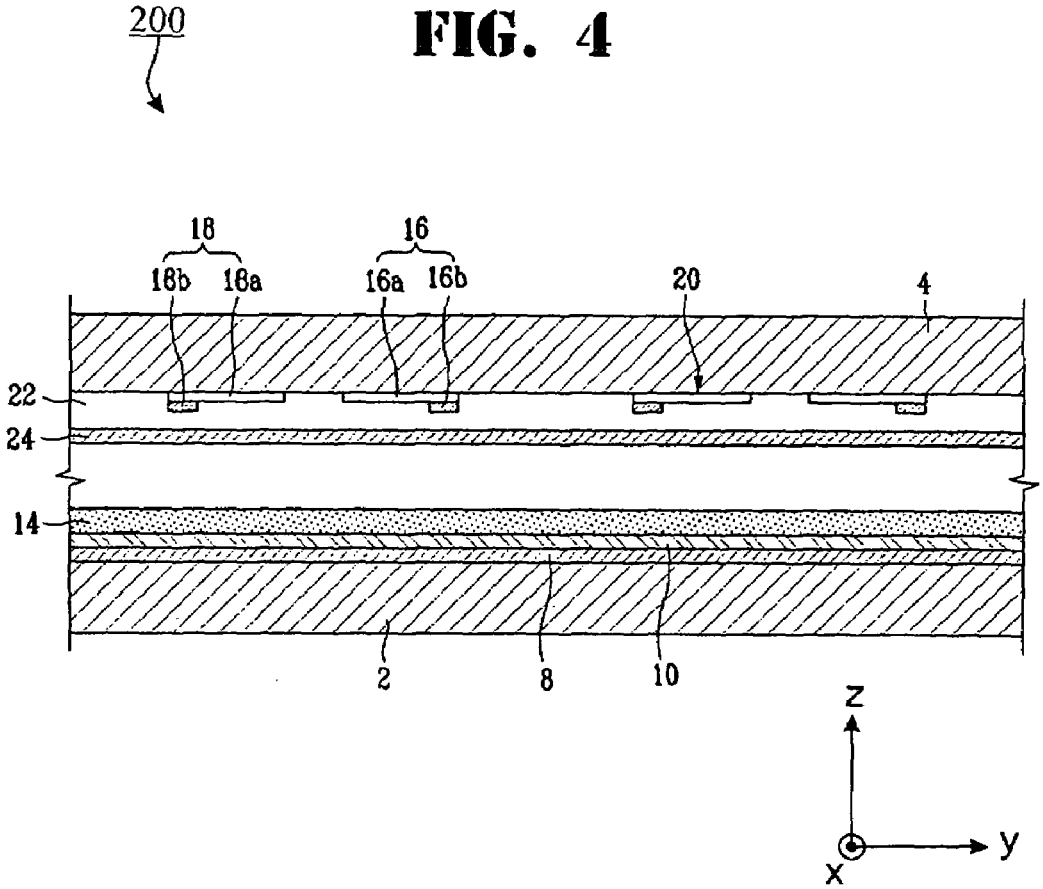
FIG. 4 is a partial sectional view of the PDP illustrated in FIG. 2, illustrating the combined structure thereof.

Turning now to FIGS. 2 through 4, FIG. 2 is a partial exploded perspective view of a PDP 200 according to an embodiment of the present invention, and FIGS. 3 and 4 are partial plan and sectional views respectively of the PDP 200 illustrated in FIG. 2, illustrating the combined structure thereof. As illustrated in FIGS. 2 through 4, the PDP 200 includes first and second substrates 2 and 4 spaced apart from each other with a distance therebetween. Discharge cells 6R, 6G, and 6B are arranged between the substrates 2 and 4 to emit visible rays with their independent discharge mechanisms, and display desired color images.

Specifically, address electrodes 8 are formed on the inner surface of the first substrate 2 in a direction (in the Y direction of the drawing), and a lower dielectric layer 10 is formed on the entire surface of the first substrate 2 covering the address electrodes 8. Stripe-patterned barrier ribs 12 are formed on the lower dielectric layer 10 and are formed to be parallel to the address electrodes 8. Red, green, and blue phosphor layers 14R, 14G, and 14B are formed on the sidewalls of the barrier ribs 12 and on the top surface of the lower dielectric layer 10. The respective barrier ribs 12 are disposed between neighboring address electrodes 8 with a certain height to allow a predetermined discharge space between the first and the second substrates 2 and 4.

Discharge sustain electrodes 20 are formed on the inner surface of the second substrate 4 facing the first substrate 2. Discharge sustain electrodes 20 are formed to run in an x-direction perpendicular to the address electrodes 8. Discharge sustain electrodes 20 include a scanning electrode 16 and a display electrode 18. A transparent upper dielectric layer 22 and an MgO protective layer 24 are formed on the entire inner surface of the second substrate 4 and cover the discharge sustain electrodes 20.

In the embodiment of FIGS. 2 through 4, the scanning electrode 16 and the display electrode 18 each include a transparent portion or transparent electrode and a non-transparent and highly conductive portion or a bus electrode. The transparent portions 16*a* and 18*a* are formed respectively with metallic bus portions 16*b* and 18*b* formed at one side periphery (along one edge) of the transparent portions 16*a* and 18*a* to prevent a voltage drop in the transparent portions 16*a* and 18*a*. The transparent portions 16*a* and 18*a* are preferably formed with indium tin oxide (ITO), and the bus portions 16*b* and 18*b* are preferably formed with a highly conductive metallic material such as silver.

The discharge space between the first and the second substrates 2 and 4 defined by the crossing or overlapping of the address electrodes 8 and the discharge sustain electrodes 20 forms a discharge cell, and the discharge cells 6R, 6G, and 6B are internally filled with a discharge gas (a mixture gas of Ne—Xe).

In PDP 200, the address electrodes 8 and the discharge sustain electrodes 20 are each specially designed to reduce mis-discharging. As illustrated in FIG. 3, the gap G1 between two portions of the discharge sustain electrode 20 at the respective discharge cells 6R, 6G, and 6B becomes the main discharge gap where the plasma discharge normally occurs. The gap G2 between the discharge sustain electrode neighbors 20 at the neighboring discharge cells in the direction of the address electrode 8 (the y-direction) becomes the non-discharge gap where the plasma discharge does not ordinarily occur. That is, with the respective discharge cells 6R, 6G, and 6B, the gap between the scanning electrode 16 and the display electrode 18 within a discharge cell functions as the main discharge gap G1, and the gap between the display electrode 18 (or the scanning electrode) at any one of the discharge cells and the scanning electrode 16 (or the display electrode) for a neighboring discharge cell in the direction of the address electrode 8 (y-direction) functions as the non-discharge gap G2.

With the PDP 200 according to the embodiment of the present invention, when the main discharge gap G1 and the non-discharge gap G2 are defined as above, the width D1 of the address electrode 8 corresponding to (in the vicinity of) the main discharge gap G1 is designed to be smaller than the width D2 of the address electrode 8 corresponding to (in the vicinity of) the non-discharge gap G2.

Specifically, as illustrated in FIG. 3, when an imagined first horizontal line H1 is drawn along the central axis of the scanning electrode 16, and an imagined second horizontal line H2 is drawn along the central axis of the display electrode 18, the section between the first and the second horizontal lines H1 and H2 at the respective discharge cells 6R, 6G, and 6B is defined as a main discharge section A, and the section between the first and the second horizontal lines H1 and H2 in two neighboring discharge cells in the direction of the address electrode 8 (y-direction) is defined as a non-discharge section B.

With the PDP 200 according to the embodiment of the present invention, when the main discharge section A centered around the main discharge gap G1, and the non-discharge section B around the non-discharge gap G2 are defined in the above way, the width D1 of the address electrode 8 corresponding to the main discharge section A is designed to be smaller than the width D2 of the address electrode 8 corresponding to the non-discharge section B. That is, the address electrode 8 is structured such that the facing area (or overlapping area) between the address electrode 8 and the display electrode 18 is reduced by making the address electrode 8 narrower in this overlapping discharge region A.

With the above structure, when an address voltage Va is applied between the address electrode 8 and the scanning electrode 16, the address discharge is made within the discharge cells. As a result, wall charges are generated over the lower dielectric layer 10 near the address electrode 8, and over the upper dielectric layer 22 near the scanning electrode 16 and the display electrode 18, thereby selecting the discharge cells to emit light.

Thereafter, when a sustain voltage Vs is applied between the scanning electrode 16 and the display electrode 18, the accumulated wall charge near the scanning electrode 16 combines with the accumulated wall charges near the display electrode 18 to thus generate a plasma discharge, that is, the sustain discharge. At this time, vacuum ultraviolet rays are emitted from the excited atoms of Xe during the plasma discharge. The vacuum ultraviolet rays excite the phosphor layers to emit visible rays, and thus display color images.

With the PDP 200 according to the embodiment of the present invention, at portions where the address electrode 8 and display electrode 18 overlaps (i.e., within a discharge cell or main discharge section A), since the address electrodes 8 are narrower in the main discharge section A than outside this main discharge section A, the area of the address electrode 8 that faces (or overlaps) the display electrode 18 is reduced so that possible unnecessary discharging between the address electrode 8 and the display electrode 18 can be prevented. As a result, with the PDP 200 according to the embodiment of the present invention, the generation of wall charges due to the interactive interference between the address electrode 8 and the display electrode 18 within the discharge cells 6R, 6G, and 6B is inhibited after the reset interval, thereby preventing the discharge cells 6R, 6G, and 6B from being mis-discharged.

The width D1 of the address electrode 8 corresponding to the main discharge section A is preferably designed based on the content of Xe in the discharge gas. That is, when the address electrode 8 and the display electrode 18 face (or overlap) each other, the higher the content of Xe in the discharge gas is, the more the mis-discharging occurs between the address electrode 8 and the display electrode 18. Therefore, as the content of Xe in the discharge gas is increased, the facing area (or overlapping area) between the address electrode 8 and the display electrode 18 should be reduced to prevent the mis-discharging between these two electrodes. Thus, it is preferable to have the width D1 of the address electrode 8 in main discharge section A to be most narrow for higher contents of Xe, and to allow D1 to be a bit wider for lower contents of Xe.

With the PDP 200 according to the embodiment of the present invention, the discharge gas contains 5% or more of Xe, preferably 10~30% of Xe, to enhance the light emission efficiency. Furthermore, the width D1 of the address electrode 8 corresponding to the discharge section A is established to be 40~140 μm, thus reducing the facing or overlap area between the address electrode 8 and the display electrode 18 and thus preventing the mis-discharge between the address electrode 8 and the display electrode 18. In this case, the width D2 of the address electrode 8 corresponding to the non-discharge section B is preferably designed to be about 180 μm.

Figure 5:
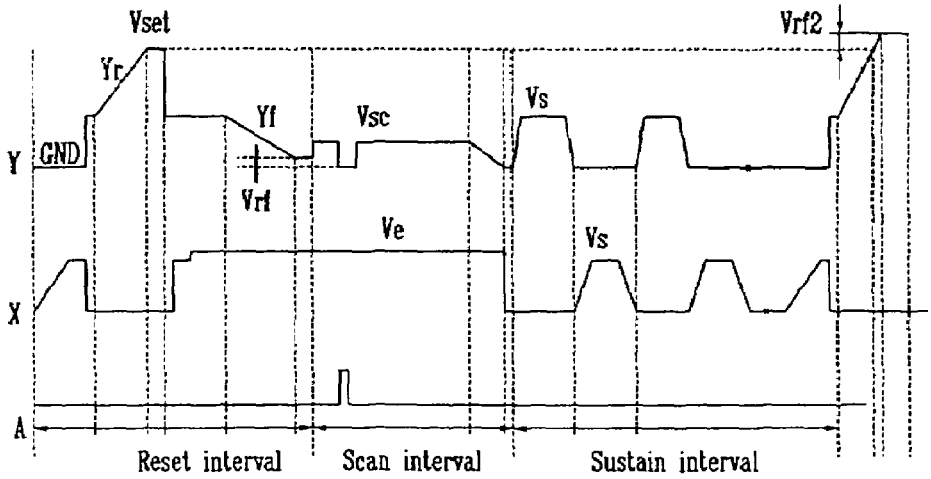
FIG. 5 is a waveform diagram illustrating a method of driving the PDP according to an embodiment of the present invention.

Table 1 illustrates empirical measurement results related to the mis-discharging between the address electrode 8 and the display electrode 18 while varying the width D1 of the address electrode 8 in the main discharge section A and while varying the content Xe in the discharge gas. In Table 1, ○ indicates occurrence of mis-discharging for a particular width D1 and a particular Xe content while an x indicates non-occurrence of mis-discharging for a particular width D1 and a particular Xe content. The PDP used in Table 1 was a 42-inch ADS driving PDP (a PDP that abides by address, display-period separation driving method), the width of the display electrode of the PDP was 340 μm, and the voltage waveform was the same as that illustrated in FIG. 5. The driving voltages as a function of the Xe content are listed in Table 2.

TABLE 1

| | | Content of Xe in discharge gas (%) | | | |
|---|---|---|---|---|---|
| | | 10 | 15 | 20 | 30 |
| Width D1 of address electrode 8 in the vicinity of main discharge section A (μm) | 40 | x | x | x | x |
| | 60 | x | x | x | x |
| | 80 | x | x | x | x |
| | 100 | x | x | x | x |
| | 120 | x | x | x | ○ |
| | 140 | x | ○ | ○ | ○ |
| | 160 | ○ | ○ | ○ | ○ |
| | 180 | ○ | ○ | ○ | ○ |

TABLE 2

| | | Content of Xe in discharge gas (%) | | | |
|---|---|---|---|---|---|
| | | 10 | 15 | 20 | 30 |
| Driving voltage (V) | Vset | 360 | 390 | 420 | 420 |
| | Ve | 200 | 220 | 250 | 250 |
| | Vscan | 80 | 100 | 120 | 120 |
| | Va | 85 | 85 | 95 | 95 |
| | Vs | 210 | 230 | 250 | 250 |

As illustrated by Tables 1 and 2 above, when the content of Xe in the discharge gas was 10~30%, and the width D1 of the address electrode 8 in the vicinity of the main discharge section A was 40~140 μm, the light emission efficiency was enhanced while unnecessary discharging between the address electrode 8 and the display electrode 18 was inhibited, thus preventing the discharge cells 6R, 6G, and 6B from being mis-discharged.

Figure 6:
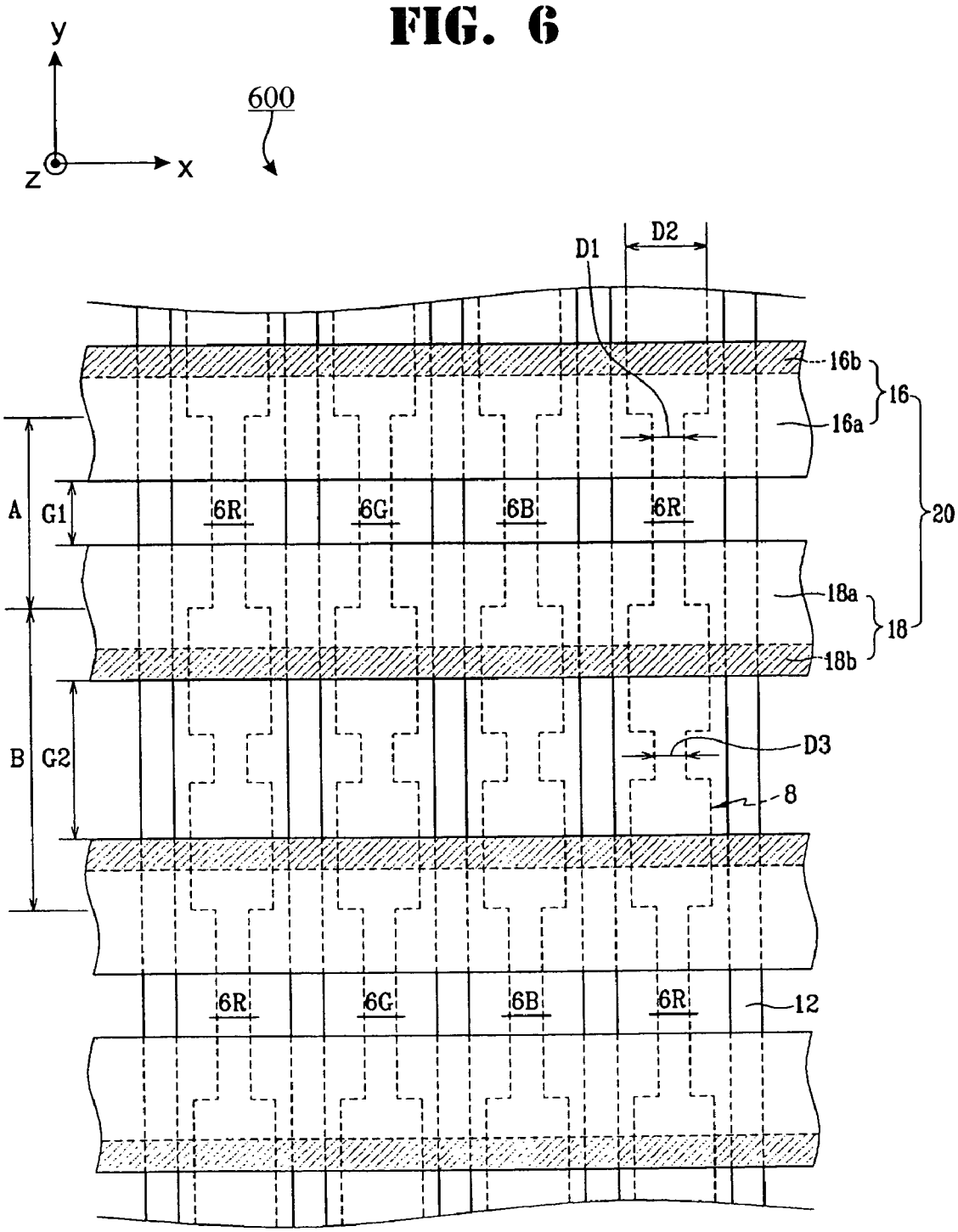
FIGS. 6 and 7 are partial plan views and of variants of the PDP according to an embodiment of the present invention.

Turning now to FIGS. 6 through 9, FIGS. 6 through 9 illustrate additional structural features of a PDP that can be added to the PDP 200 of FIGS. 2 through 4 and thus produce variants of PDP 200. Turning now to FIG. 6, FIG. 6 illustrates a first variant in PDP 200 according to the present invention. With the basic structure related to the PDP according to the present invention, the width of a portion of the address electrode 8 corresponding to the non-discharge section B is reduced from D2 to D3. That is, in this variant, the width D3 of the address electrode 8 corresponding to the center of the non-discharge section B is smaller than the width D2 of the address electrode 8 corresponding to remaining portions of the non-discharge section B in the PDP 600 of FIG. 6. For instance, the width D3 of the address electrode 8 corresponding to the center of the non-discharge section B may be the same as the width D1 of the address electrode 8 corresponding to the main discharge section A. Accordingly, with the variant of the PDP where the width of the address electrode 8 corresponding to a middle portion of the non-discharge section B is partially reduced, mis-discharging between the cells spaced from each other in the y-direction by non-discharge gap G2 can be prevented.

Figure 7:
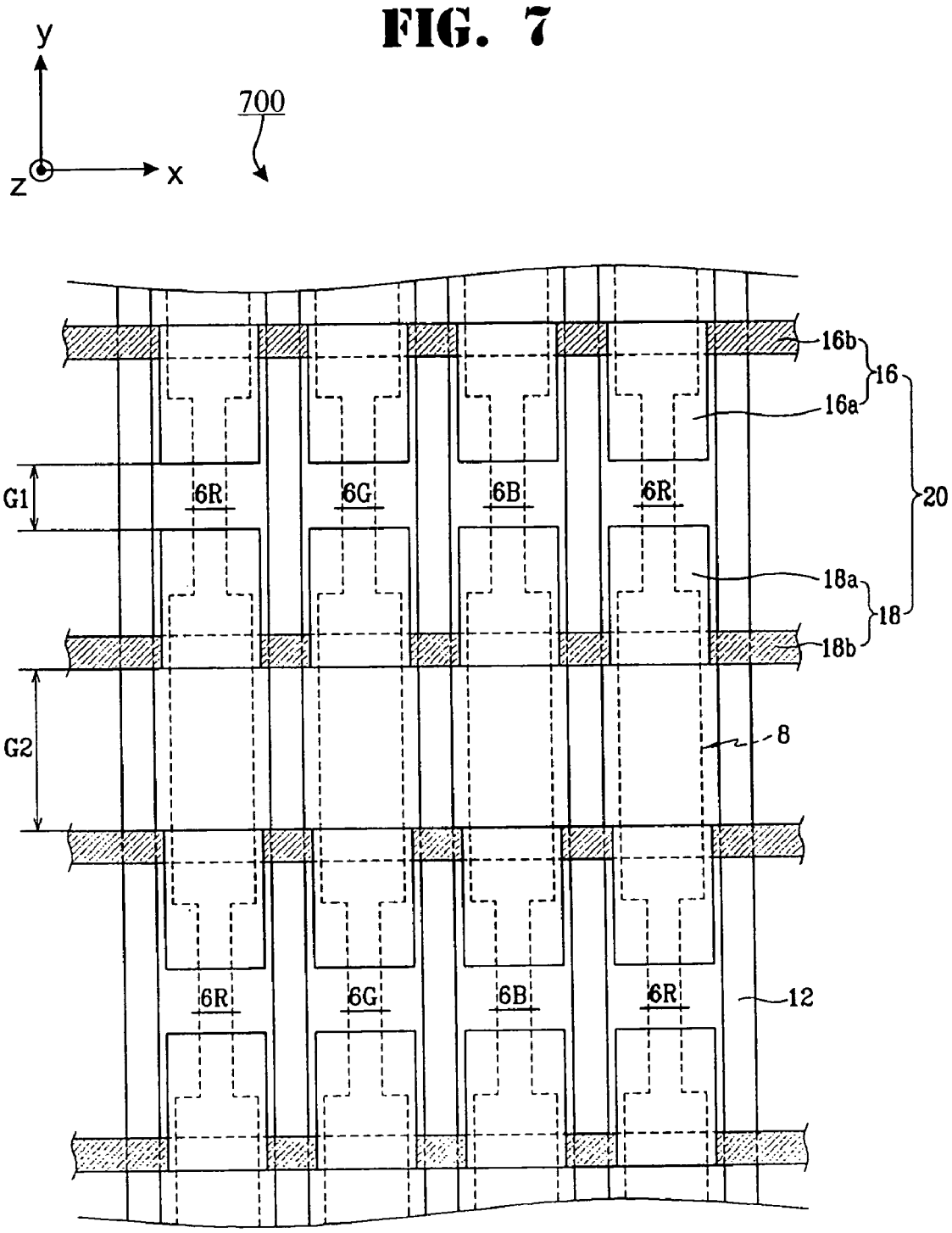

Turning now to FIG. 7, FIG. 7 illustrates a second variant in PDP 200 according to the present invention. With the basic structure related to the PDP according to the embodiment of the present invention, the transparent portions or transparent electrodes 16*a* and 18*a* of the discharge sustain electrode 20 are formed as protrusion types such that they extend from the bus portions 16*b* and 18*b* toward a center of the respective discharge cells 6R, 6G, and 6B, and a pair thereof face each other in the middle of the discharge cell and are separated from each other by main discharge gap G1. With the protrusion-type transparent portions 16*a* and 18*a* of PDP 700 of FIG. 7, the discharge cells 6R, 6G, and 6B can be prevented from being mis-discharged in the direction of the discharge sustain electrode 20 (i.e., the x-direction). Thus, in the variant PDP 700 of FIG. 7, the transparent portions 16*a* and 18*a* protrude in the y-direction as individual tabs for each discharge cell instead of merely making the electrodes wider as in PDP 200. By having the transparent portions 16*a* and 18*a* as tabs instead of a continuously wide electrode, mis-discharging between neighboring discharge cells in the x-direction is further prevented.

Figure 8:
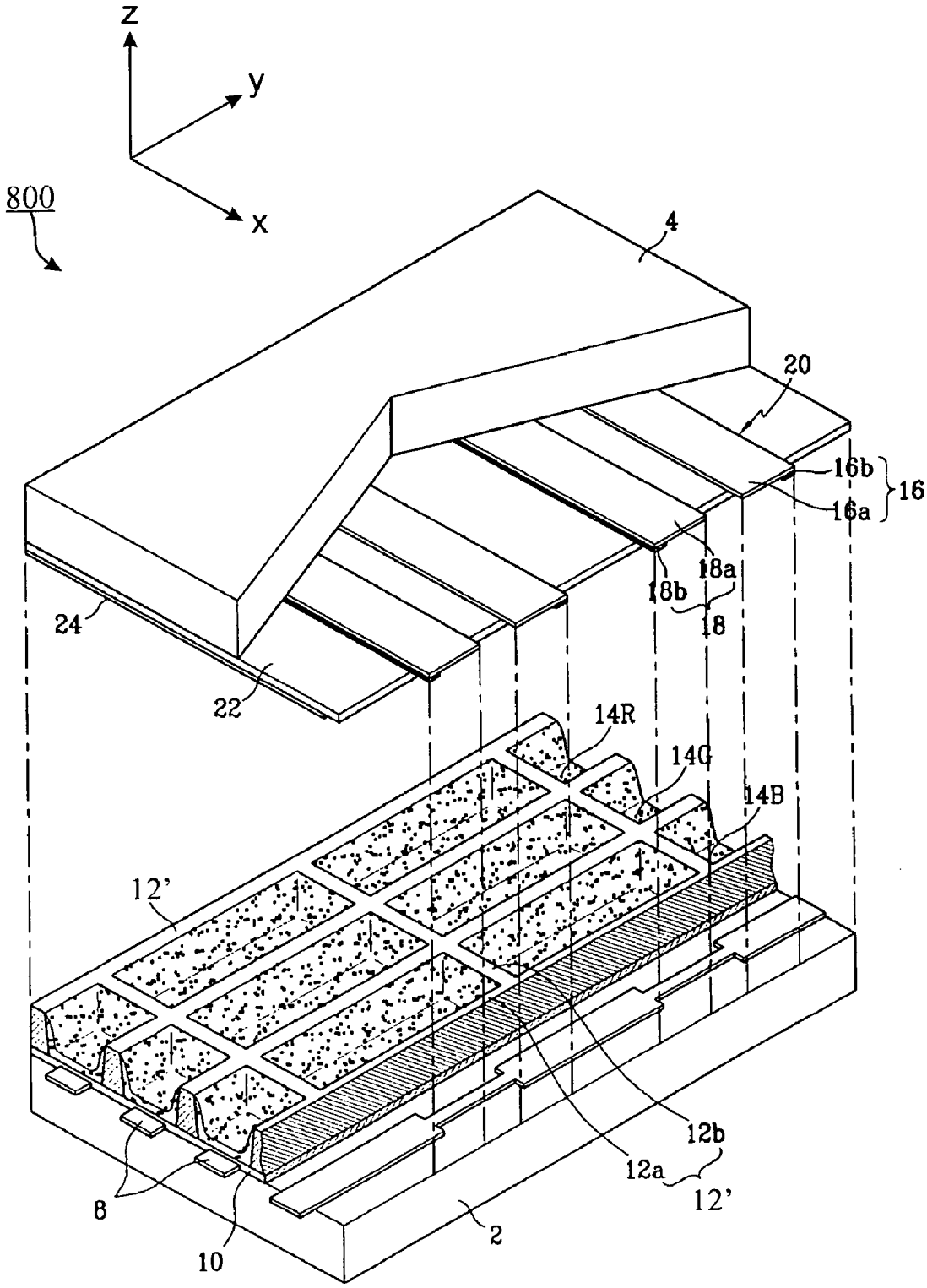
FIGS. 8 and 9 are a partial exploded perspective view and a partial plan view of another variant of the PDP according to an embodiment of the present invention.
Figure 9:
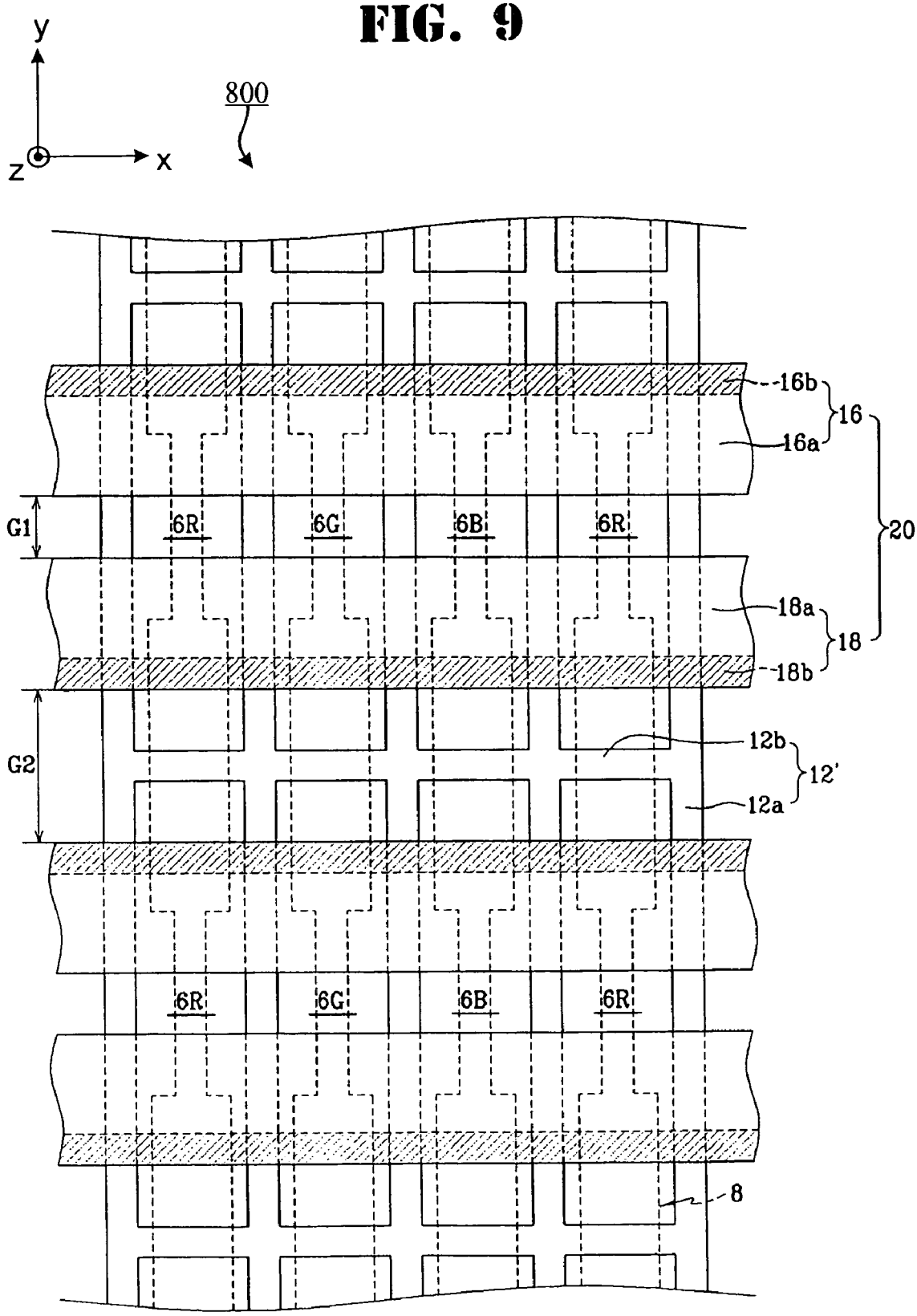

Turning now to FIGS. 8 and 9, FIGS. 8 and 9 illustrate a third variant of PDP 200 according to the present invention. PDP 800 of FIGS. 8 and 9 differs from PDP 200 in that the barrier ribs 12' are of a lattice or a matrix form instead of merely being of a stripe pattern. With the basic structure related to the PDP 800 according to the embodiment of the present invention, the barrier rib 12' is lattice-shaped with a first barrier rib portion 12*a* proceeding in the direction parallel to the address electrodes 8 (y-direction), and a second barrier rib portion 12*b* proceeding perpendicular to the address electrodes 8 (in an x-direction). The lattice-shaped barrier rib 12' partitions the respective discharge cells 6R, 6G, and 6B separately, thereby further preventing the mis-discharge between neighboring discharge cells 6R, 6G, and 6B.

As described above, with the inventive PDP, unnecessary discharging between the address electrode and the display electrode is inhibited to thereby prevent the discharge cells from being mis-discharged. Furthermore, the discharge gas contains 5% or more of Xe, preferably 10-30% of Xe, thereby heightening the intensity of the vacuum ultraviolet rays, and enhancing the light emission efficiency.

Although embodiments of the present invention have been described in detail hereinabove in connection with exemplary embodiments, it should be understood that the invention is not limited to the disclosed exemplary embodiments, but, on the contrary is intended to cover various and/or equivalent arrangements included within the spirit and scope of the present invention, as defined in the appended claims. It is also to be appreciated that the variants of FIGS. 6 through 9 can be mixed together in any combination and still be within the scope of the present invention.

What is claimed is:

1. A plasma display panel, comprising:

first and second substrates facing each other and separated from each other by a distance;

a plurality of address electrodes arranged on the first substrate;

a plurality of barrier ribs arranged between the first and the second substrates partitioning space between the first and the second substrate into a plurality of discharge cells;

a phosphor layer arranged within each of the plurality of discharge cells; and a plurality of discharge sustain electrodes arranged on the second substrate, each of the plurality of discharge sustain electrodes comprising a scanning electrode and a display electrode, wherein ones of the plurality of discharge cells being arranged only between scanning electrodes and display electrodes belonging to a same one of the plurality of discharge sustain electrodes, each of the plurality of address electrodes having a first width at locations between scanning electrodes and display electrodes belonging to a same one of the plurality of discharge sustain electrodes and having a second and larger width at locations between neighboring ones of the plurality of discharge sustain electrodes.

2. The plasma display panel of claim 1, wherein the first width of the address electrodes being 40~140 μm.

3. The plasma display panel of claim 1, wherein each of the plurality of discharge cells are internally filled with a discharge gas where between 10% and 30% of the discharge gas being Xe.

4. The plasma display panel of claim 1, wherein the plurality of address electrodes between neighboring ones of the plurality of discharge sustain electrodes are partially differentiated in the longitudinal direction thereof.

5. The plasma display panel of claim 4, wherein a width of the address electrodes at a center of a gap between neighboring ones of the plurality of discharge sustain electrodes are smaller than a width of the address electrodes at both end portions of the gap between neighboring ones of the plurality of discharge sustain electrodes.

6. The plasma display panel of claim 5, wherein a width of the address electrodes at a center of a gap between neighboring ones of the plurality of discharge sustain electrodes are substantially the same as the width of the address electrodes at both end portions of the gap between neighboring ones of the plurality of discharge sustain electrodes.

7. A plasma display panel, comprising:

first and second substrates facing each other with a space arranged therebetween;

a plurality of address electrodes arranged on the first substrate;

a plurality of barrier ribs arranged between the first and the second substrates partitioning the space between the first substrate and the second substrate into a plurality of discharge cells;

a phosphor layer arranged within each of the plurality of discharge cells; and a plurality of discharge sustain electrodes arranged on the second substrate, each of said plurality of discharge sustain electrodes comprises a scanning electrode and a display electrode, wherein a main discharge section comprising ones of the plurality of discharge cells being arranged only between a scanning electrode belonging to one of the plurality of discharge sustain electrodes and a display electrode belonging to a same one of the plurality of discharge sustain electrodes, and wherein a non-discharge section absent of any discharge cells being arranged only between a scanning electrode of one of the plurality of discharge sustain electrodes and a display electrode of a neighboring one of the plurality of discharge sustain electrodes, wherein ones of the plurality of address electrodes have a first width within a non-discharge section and having a second and smaller width within a main discharge section.

8. The plasma display panel of claim 7, the second width of the address electrodes being 40~140 μm.

9. The plasma display panel of claim 7, wherein the plurality of discharge cells being internally filled with a discharge gas having an Xe content of 10 to 30%.

10. The plasma display panel of claim 7, wherein the address electrodes in the non-discharge section being partially differentiated in the longitudinal direction thereof.

11. The plasma display panel of claim 10, wherein the width of the address electrodes at a center of the non-discharge section are smaller than the width of the address electrodes at both end portions of the non-discharge section.

12. The plasma display panel of claim 11, wherein the width of the address electrodes at the center of the non-discharge section being substantially the same as the width of the address electrodes in the main discharge section.

13. The plasma display panel of claim 7, wherein the barrier ribs are in a striped-pattern and are parallel to the address electrodes.

14. The plasma display panel of claim 7, wherein the barrier ribs are lattice-shaped and comprise:

a first barrier rib portion arranged in the direction parallel to the address electrodes; and a second barrier rib portion arranged in the direction parallel to the discharge sustain electrode.

15. The plasma display panel of claim 7, wherein each scanning electrode and each display electrode each comprises:

a transparent portion; and a bus portion arranged at one side and at a periphery of the transparent portion and being electrically connected to the transparent portion, the transparent portions protruding toward a center of respective discharge cells, the transparent portions facing each other in pairs.

16. A plasma display panel, comprising:

a first substrate and a second substrate facing a first substrate with a space there between;

a plurality of address electrodes arranged in a first direction on the first substrate;

a plurality of discharge sustain electrodes arranged in a second direction on the second substrate, the second direction being orthogonal to the first direction;

a plurality of barrier ribs arranged between the first and the second substrates and dividing the space between the first and the second substrates into a plurality of discharge cells, the barrier ribs being in non-discharge cell regions and spaces between the barrier ribs being discharge cell regions corresponding to the plurality of discharge cells;

a phosphor layer arranged within each of said plurality of discharge cells; and a discharge gas filling each of said plurality of discharge cells, the address electrode having a width that varies in said first direction, the address electrodes having a first width at discharge cell regions and having a second and larger width at non-discharge cell regions.

17. The plasma display panel of claim 16, the discharge gas having a Xe content of at least 10%.

18. The plasma display panel of claim 16, the address electrodes having a first width at locations where they overlap the discharge sustain electrodes and having a second and larger width at all other regions where they do not overlap the discharge sustain electrodes.

* * * * *